US006754928B1

(12) United States Patent
Rosen

(10) Patent No.: US 6,754,928 B1
(45) **Date of Patent: *Jun. 29, 2004**

(54) BRUSHING BEHAVIOR REINFORCEMENT TOOTHBRUSH AND ENCLOSED ELECTRONIC GAME SWITCH WITH GRID

(76) Inventor: Howard Rosen, 5756 Royalmount Avenue, Montreal, Quebec (CA), H4P 1K5

( * ) Notice: Subject to any disclaimer, the term of this patent is extended or adjusted under 35 U.S.C. 154(b) by 0 days.

This patent is subject to a terminal disclaimer.

(21) Appl. No.: 09/500,169

(22) Filed: Feb. 8, 2000

(51) Int. Cl.[7] ..... A46B 9/04; A46B 15/00

(52) U.S. Cl. ..... 15/105; 15/167.1; 433/216; 446/484

(58) Field of Search ..... 446/484; 15/105, 15/167.1; 433/216

(56) References Cited

U.S. PATENT DOCUMENTS 4,253,212 A * 3/1981 Fujita
4,341,230 A * 7/1982 Siahou
4,744,124 A * 5/1988 Wang
5,134,743 A * 8/1992 Hukuba
5,572,762 A * 11/1996 Scheiner
5,673,451 A * 10/1997 Moore
5,924,159 A * 7/1999 Haitin
6,397,424 B1 * 6/2002 Leung

* cited by examiner

*Primary Examiner*—Randall E. Chin
(74) *Attorney, Agent, or Firm*—David Bracken

(57) ABSTRACT

The present invention comprises a toothbrush supporting brushing behavior reinforcement means. A simple motion sensing means is electrically connected to a brushing logic means, which determines generalized brushing action of a user preferably a child. After the logic requirements of motion sensing are complete, the logic means directs a digital output display means to output to a small LCD screen or speaker a visual and/or audible reward to the user, preferably in the form of an enjoyable game or congratulatory message. A grid of electrical contacts may be used to determine motion or direction when connected with logic means.

1 Claim, 7 Drawing Sheets

FIGURE 2

BRUSHING BEHAVIOR REINFORCEMENT TOOTHBRUSH AND ENCLOSED ELECTRONIC GAME SWITCH WITH GRID

FIELD AND BACKGROUND OF THE INVENTION

The present invention relates to a toothbrush having the capability of reinforcing brushing behavior.

Encouraging young and sometimes older persons to brush their teeth at low cost results in a high value benefit to the individual. The present art for low cost LCD and other displays as well as low cost audio outputs places within economic reach such devices for incorporation into a toothbrush for interactive encouragement and detection of failure to begin or complete brushing.

SUMMARY OF THE INVENTION

The present invention comprises a toothbrush supporting brushing behavior reinforcement means. A simple motion sensing means is electrically connected to a brushing logic means, which determines generalized brushing action of a user preferably a child. After the logic requirements of motion sensing are complete, the logic means directs a digital output display means to output to a small LCD screen or speaker a visual and/or audible reward to the user, preferably in the form of an enjoyable game or congratulatory message. The present invention also comprises a method of commercial promotion in which the invention toothbrush is provided in its visual or audible display a promoted character voice or shape for the game or congratulatory message, such that free or below cost giveaway by a fast food or similar enterprise potentially increases its business.

BRIEF DESCRIPTION OF THE DRAWINGS

FIGS. 15 and 16 are, respectively, a side view of the slider of FIG. 14 and Section A—A of FIG. 15.

DETAILED DESCRIPTION OF THE INVENTION

Figure 1:
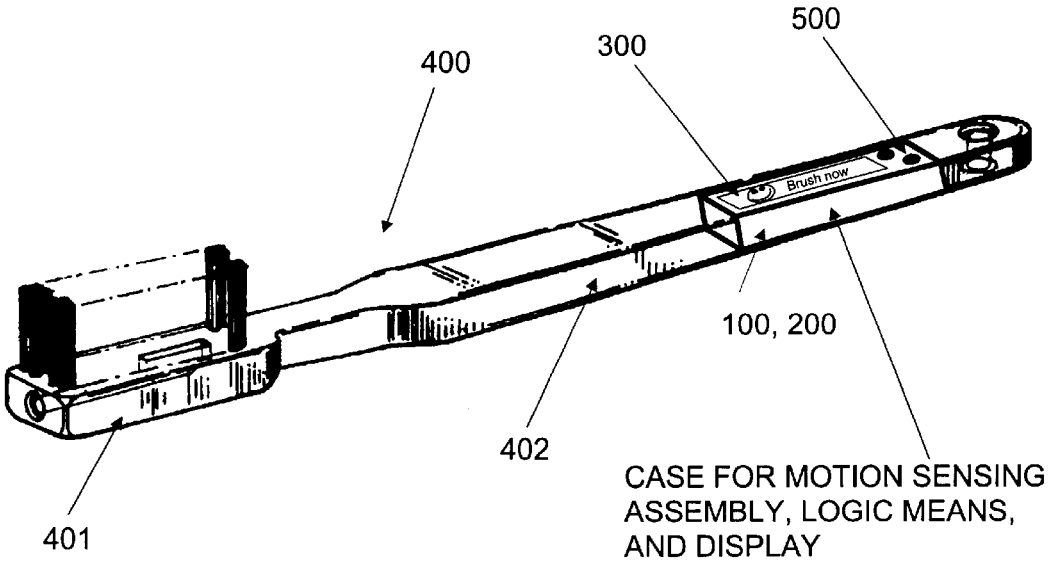
FIG. 1 is a perspective view of the invention toothbrush in one embodiment.

FIG. 1 shows a toothbrush 400 with a conventional head 401 and handle 402. The invention motion sensing means 100, logic means 200 and display means 300 are contained in this specific example in a small handle-supported case as shown in FIG. 1, which handle support case comprises buttons 500 communicating with logic means 200 for input and/or game play as described below.

Figure 2:
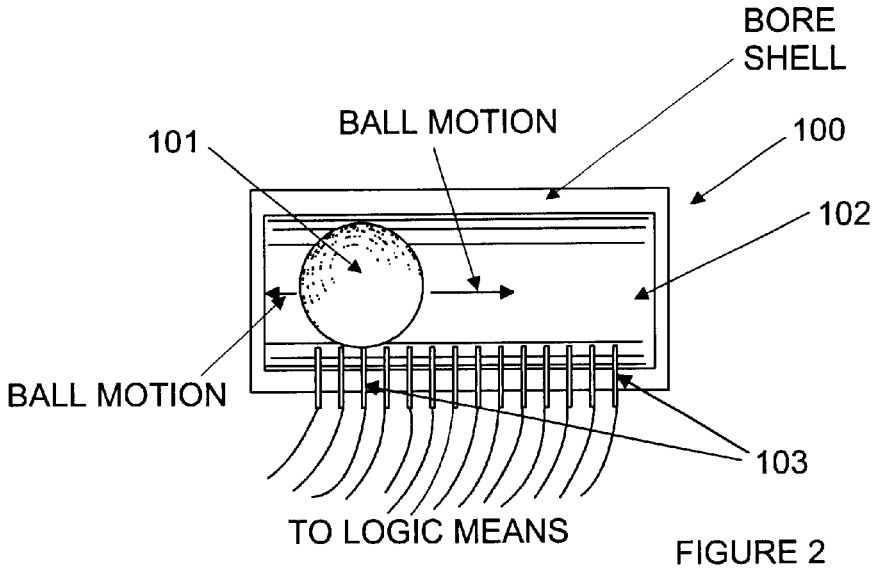
FIG. 2 is cut-away side view of the cylindrical bore in a shell for a motion sensing means of the invention toothbrush.

The present invention comprises a toothbrush with a handle sufficient to support and preferably at least partially encase motion sensing means 100, logic means 200 and a digital output display means 300. Motion sensing means 100 are shown in FIG. 2, whereby a metallic or metallic surfaced ball 101 is located in a non-conductive bore 102. The bore has intruding into it electrical contacts 103, the contacts preferably comprising a simple wire end with sufficient stiffness that it will not bend upon ball contact as described below. Contacts 103 and ball 101 are arranged so that the ball may roll relatively freely across the contacts so that the ball contacts only one or two contacts at any time, although it is preferable that the bore, contacts and ball are arranged such that ball 101 is in contact with at least one contact at all times. Contacts 103 are preferably separated by about 0.012 inches. When bore 102 is oriented so that contacts 103 are located above ball 101 respective to gravity, it is intended that normal vigorous toothbrushing motion will cause the ball to bump into two contacts in the "ceiling" of bore 102.

Bore 102 is preferably aligned with the longitudinal axis of the toothbrush handle, although the objects of the present invention may at least in part be achieved if bore 102 is aligned at an angle or perpendicular to that axis. It is intended that the relationship of the ball within the bore permit the ball to move into and away from contact with two contacts from time to time upon significant motion of the toothbrush. Each contact and breaking of contact of ball 101 with two contacts 103 respectively completes and breaks an electrical circuit electrically connected with logic means 200. Motion sensing according the invention is determined by the logic means 200 by sensing within a clock period a minimum number of electrical contact completions and breaks, which means are provided with a simple clock and counting means therein. As a simple example of the invention motion sensing method, a user may pick up the toothbrush and apply toothpaste or otherwise manipulate the toothbrush, causing ball 101 to make or break electrical connection with contacts 103, say 10 times in 20 seconds, by that motion. However, logic means 200 will contain programming sufficient to compare the number of makes/breaks over a 20 second interval so that brushing motion detection is not recognized until the number of makes/breaks is greater than 10.

The orientation of ball 101 in bore 102 provides relatively free, undamped movement therein. In an alternate embodiment, damping fluid such as a non-conductive oil may fill bore 102 thereby reducing makes/breaks to the logic means 200 by making simple, non-vigorous brushing motion of the toothbrush.

Logic means 200 comprises circuitry, memory and/or microprocessors with a real time clock for correlating brush strokes and time, and means 200 also goes to sleep and/or directs an output to display means 300 at 30 to 60 seconds after logic means ceases to sense makes or breaks from means 100. At the sensing a first make or break from means 100, logic means 200 wakes up and receives in an undifferentiated manner the make/break information from ball 101 and contacts 103. Logic means 200 simply counts makes and breaks in a predetermined time period and compares that number with a predetermined number of makes/breaks. If the number of actual makes/breaks exceeds the predetermined number, logic means 200 directs output to display means 300 in a manner to indicate to the user that a desired behavior is achieved or not achieved.

The invention assembly is powered by a small battery and designed to meet low power requirements of the components for a relatively long period of time.

Display means 300 are provided with an LCD display with or without audible output to the user. The visual and/or audible output is a critical part of the invention. Optional outputs are shown in the figures.

Figure 3:
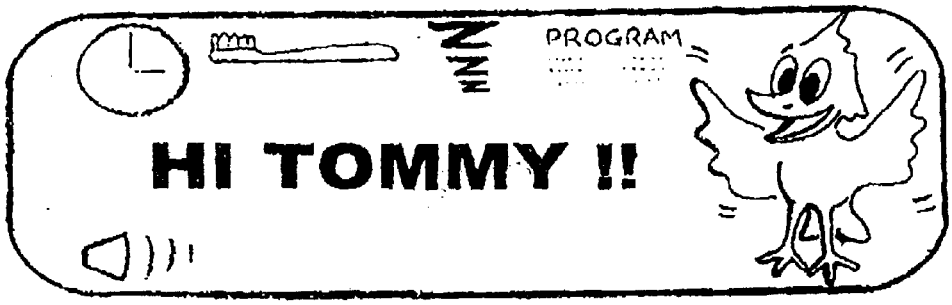
FIG. 3 is an exemplary LCD display of the display means of the invention toothbrush.
Figure 4:
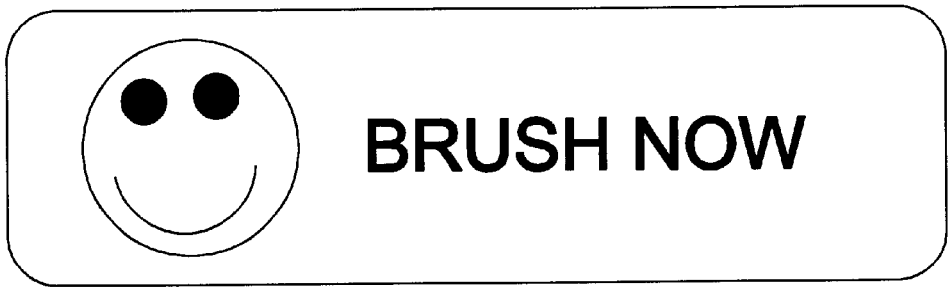
FIG. 4 is a "sleep" mode display for an exemplary LCD display.

FIG. 3 shows a display with means for identifying sleep, wakeup, name, sound and time modes. FIG. 4 shows another embodiment of the display for a sleep mode where after lack of makes/breaks from means 100 at about 2 minutes, means 200 causes the means 300 to present an initial encouragement display. The BRUSH NOW/PLAY LATER encourages the user to begin brushing with the inducement of a game play later.

Figure 5:
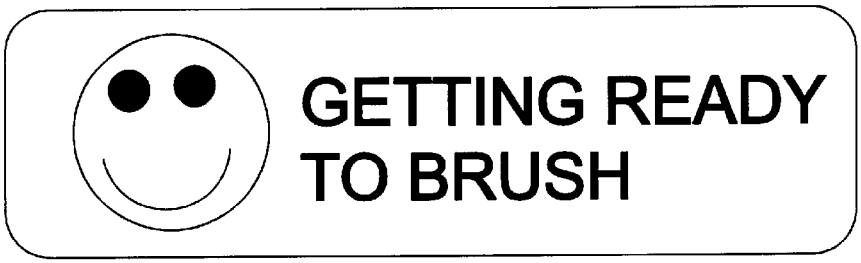
FIG. 5 is an initiation mode display for the LCD display of FIG. 4.

FIG. 5 is an initiation mode display for the LCD display of FIG. 4. This mode is the period of time in which the user first picks up the toothbrush and manipulates it to apply toothpaste and other preparations. In a hygienists office, the hygienist may prepare the toothbrush. The display GETTING READY TO BRUSH display disappears and is replaced with the display of FIG. 6 for a brushing period mode display of BRUSHING TO PLAY/PART 1 when the frequency of the make/breaks of means 100 exceeds a certain minimum.

Figure 6:
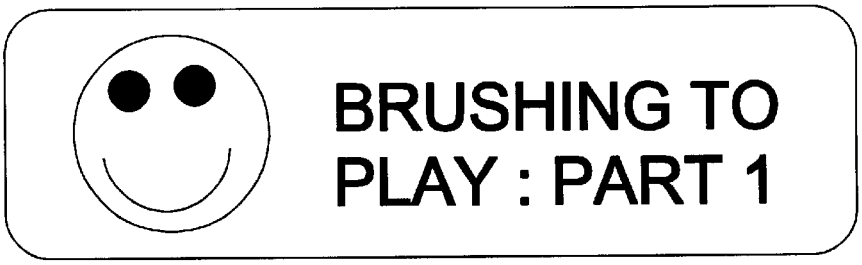
FIG. 6 is a brushing period mode display for the LCD display of FIG. 4.
Figure 10:
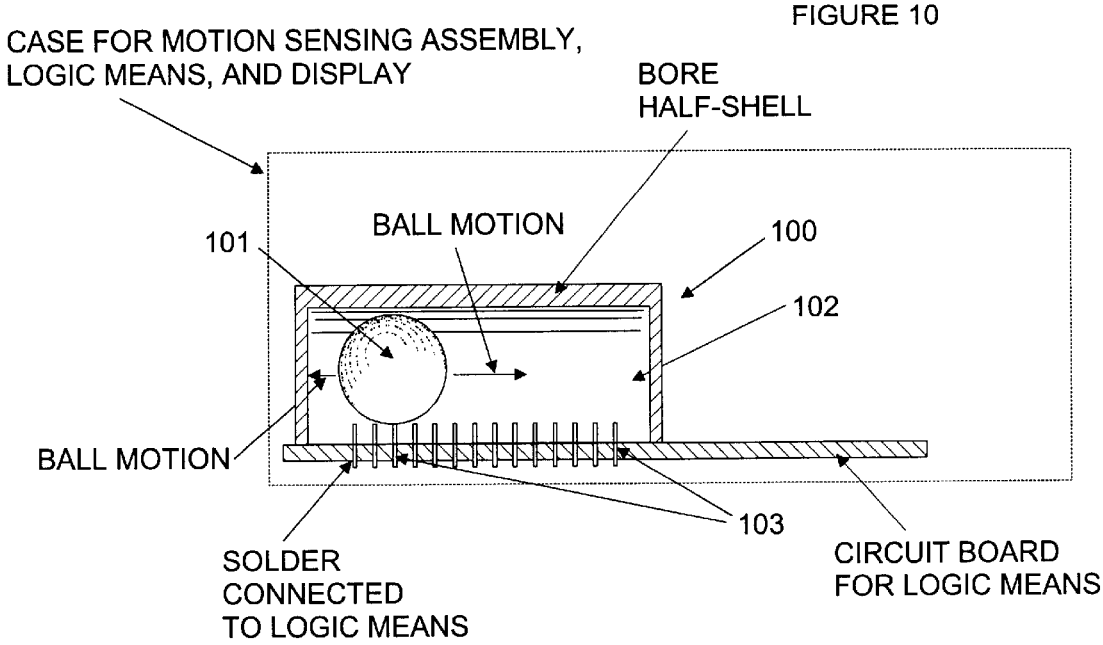
FIG. 10 is a cut-away side view of half-shell with a bore mounted on a circuit board for an alternate embodiment of the motion sensing assembly.

In one embodiment of the invention, the PART 1 display of FIG. 6 indicates that the user must brush for a predetermined period and then stop brushing, whereupon the game playing mode of FIG. 10 is accessible to the user. In another embodiment of the invention, that PART 1 display indicates that the user must stop brushing for a short period of time (requiring brushing in a tooth zone such as top teeth or a quadrant) and then must begin brushing again, whereupon the display changes to PART 2: Alternatively, a PART 1/2 may show alternate highlighting of the "1" or "2" depending on the zone being brushed.

Figure 7:
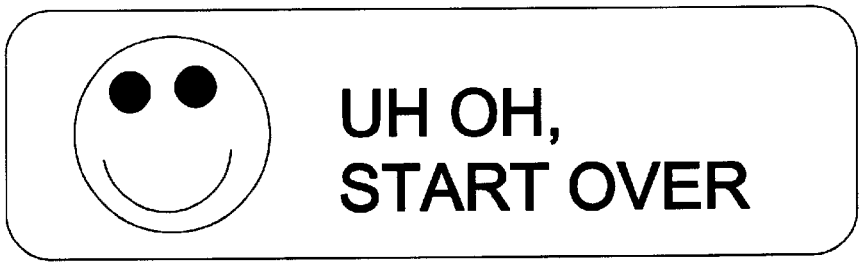
FIG. 7 is a brushing failure mode display for the LCD display of FIG. 4.

FIG. 7 is a brushing failure mode display UH OH, START OVER wherein means 200 has detected that brushing motion sensing has stopped for been reduced in minimum frequency. Means 200 provides that once minimum make/break frequency is re-established, the zone completion modes of the previous paragraph are reset for completion.

Figure 8:
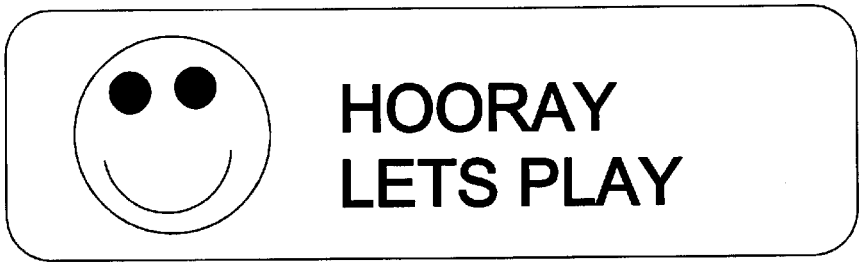
FIG. 8 is a brushing overall success mode display for the LCD display of FIG. 4.

FIG. 8 is a brushing overall success mode display of HOORAY LET'S PLAY for the LCD display of FIG. 4. This mode is displayed for a short period of time before the display of FIG. 9 is presented.

Figure 9:
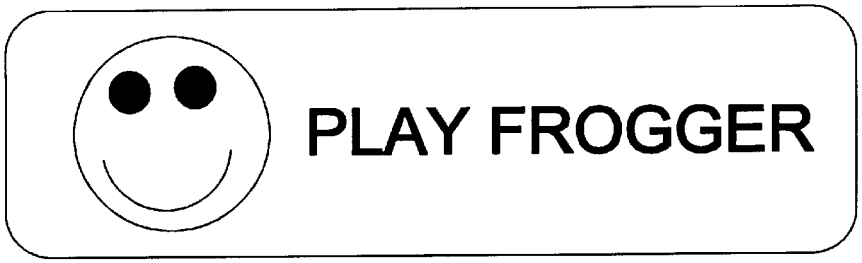
FIG. 9 is a brushing success game mode display for the LCD display of FIG. 4.

FIG. 9 is a brushing success game mode display for the LCD display of FIG. 4. This portion of the programming of means 200 comprises a simple game such as are common for such small screens as in the present invention. Such games comprise the electronic "pet" care games, making the pet survival at least partly dependent on successful toothbrushing, or skill games such as "Frogger" or other such games. The user is permitted to play the game for a predetermined period of time or skill level, whereupon the display returns to that of FIG. 4, the programming having been reset to begin the invention process again.

In an alternate embodiment of the present invention, the sleep mode indication on the display and in the reward programming will remain in effect until the count frequency of the make/breaks exceeds a brushing count frequency, such that the display will change only after brushing count frequency for the toothbrush is achieved. With this embodiment, the user only views a sleep mode display, a brushing mode display, and a reward display for a "success" animation, sound or game as a reward for completion of brushing.

The present reward display for at the FIG. 9 level can be configured with a currently popular cartoon or movie figure as a promotional item, making this low cost toothbrush an attractive give-away item for fast food and other such businesses. Thus, the present invention comprises a method for promotional give-aways or sales to improve business throughput of a fast food restaurant or other such business.

Figure 11:
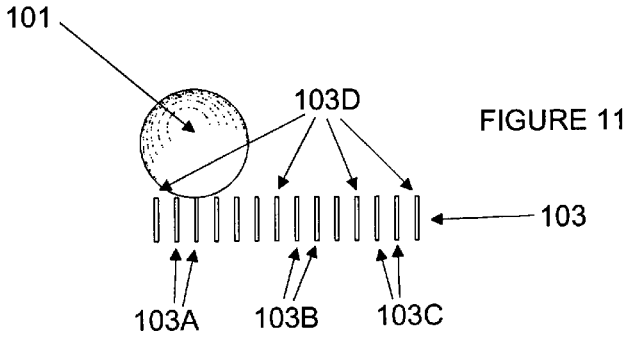
FIG. 11 is a side view of only the contacts and ball of the motion sensing assembly identifying game switches or game switch zones.

FIG. 10 is a cut-away side view of a half-cylinder fixed to a top side of a circuit board on which may be mounted the logic means components. It is preferred in this embodiment that the arrows indicating ball motion are substantially parallel to the axis of the toothbrush so that axial back and forth motion of the toothbrush will cause the ball 101 to roll back and forth. Contacts 103 penetrate the circuit board and are solder connected with the logic means on the bottom side of the circuit board. In an alternate embodiment of the contacts 103 and bail 101 relationship for sensing counts, FIG. 11 shows only contacts 103 and ball 101, although the shell and bore and logic means connections of the other Figures are implied. In the FIG. 11 embodiment, left zone 103A, center zone 103B and right zone 103C each comprises only 2 contacts, although more than two contacts may be adjacently a part of each such zone. During game mode operation, the logic means senses and differentiates counts from each of left zone 103A, center zone 103B and right zone 103C as switches for game playing, eliminating buttons 500 from the present invention entirely and permitting watertight enclosure of the motion sensing assembly, the logic means, display and battery powering the invention within the case shown in FIG. 1.

Figure 12:
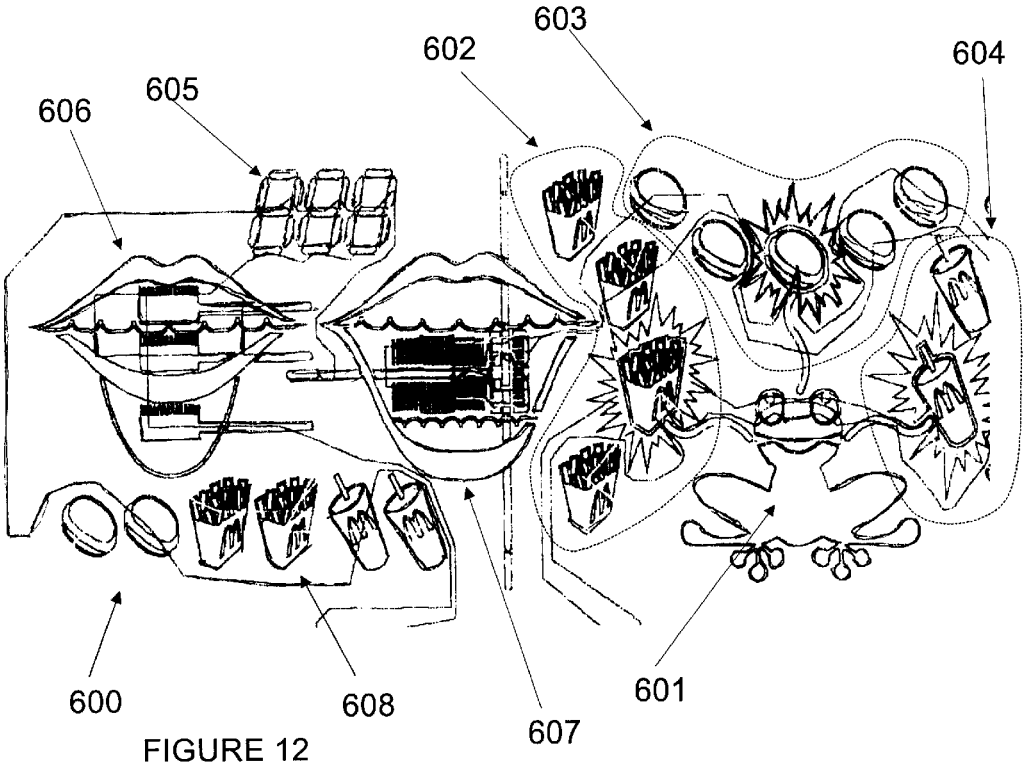
FIG. 12 is an alternate display screen for the invention showing brushing instruction and game aspects of the invention.

As shown in FIG. 12 display for the invention, left zone 103A contacts in the game mode connected by the ball register cause the logic means to register as a left zone 602 action, center zone 103B contacts in the game mode connected by the ball register cause the logic means to register as a center zone 603 action and right zone 103C contacts in the, game mode connected by the ball register cause the logic means to register as a right zone 604 action. The registry of the actions optionally causes a highlighting in the zones 602–604 and/or point accumulation in point display 605. The game of FIG. 12, as an example of the invention reward or game mode, comprises a frog or capture FIG. 601 having the ability to reach with its tongue to "capture" objects in the zones 602–604. The "capture" activity comprises the steps, say for left zone 602, of requiring the user to angle the toothbrush axis down to the left to cause a connection contact in zone 103A which thereby registers a count in the logic means for that zone which results in a highlighted object in zone 602 and/or a point increase in point display 605. Similarly, the user may angle the toothbrush axis downward to the right to cause connection in zone 103C resulting in a count causing a display in zone 604 and/or an increase in points in point display 605. The traverse of ball 101 back and forth across the contacts in FIG. 11 causes a count to registered for zone 103B, resulting in a display highlight in zone 603.

The number of zones of game or reward mode-active contacts in FIG. 11 may be reduced to one or be increased to more than three depending on the game actions required in the game or reward mode. The game presented in FIG. 12 is exemplary of one of may skill games that may be included in the logic means for presentation on the display 300. For example, Frogger is a game requiring only a single game mode-active zone for moving a frog across a river with some obstacles.

Contacts 103D in FIG. 11 are optional as separation or inactive contacts during the game mode, whereby additional activity is desired to move the ball 101 from one game mode-active zone to another. The number of such contacts 103D creating such distance may be varied depending on the desired action for the game mode.

In another embodiment of the invention, the sleep mode of the logic means may be replaced with an off mode, such that the display is blank and essentially no power is delivered thereto when the number of counts is zero for a preset period of time. In this embodiment, the first count causes the logic means to show a display indicating the brushing should be taking place, i.e., the brushing mode. In the brushing mode, the logic means monitors in some form the motion sensing counts to determine if brushing is taking place in a desired manner. Such monitoring may be in one of several forms, such as (1) the number of first or actual counts within a short time period is compared to a preset number of counts for that time period (for example, 3 counts in 5 seconds), (2) the number of first or actual counts within a full time period for desired brushing activity of the entire mouth is compared to a preset number of counts for that activity (for example, 100 counts in 2 minutes), (3) the number of first or actual counts within a time period for a mouth section (top and bottom teeth, teeth quadrants, and/or tongue) is compared to a preset number of counts for that mount section (for example, 3 counts in 5 seconds), (4) the number of first or actual counts occur within a preset time period of each other, or (5) other actual count measurement methods to determine compliance with desired brushing motion. If such monitoring indicates the desired brushing motion has taken place, the logic means causes a screen display indicating that the user should move to the next mouth section for another portion of the brushing mode or that all the desired brushing is accomplished and a game may begin.

In FIG. 12, display 606 is presented in the display 300 during a portion of the brushing mode when it is desired that the user brush the teeth mouth-side surfaces up and down with teeth together. Display 606 alternately presents another view in the display 300 during a portion of the brushing mode when it is desired that the user brush the tongue, indicated by the brush outline on the tongue outline. Display 607 is presented in the display 300 during a portion of the brushing mode when it is desired that the user brush the teeth with teeth apart, and may be used to indicate that the user brush the buccal cavity and mouth side tooth surfaces in quadrants or other such divisions of that portion of the brushing mode.

The present invention also comprises a broad application of the above motion sensing means as one or more game switches capable of being enclosed away from direct user contact. The benefits of such an enclosed switch include sealing against atmospheric invasion by heat, cold, dust or liquids, such that the user could operate games in such locations as a bath, shower, beach, rainy environments, high humidity or dust environments or such that users such as young children who would tend to press too hard on buttons or chew on or drop the device in liquids could retain an operationally effective game device even after such immersion or splashing of liquids on the game device. The power source for the game device is optionally sealed in a liquid tight enclosure with the game device or in its own enclosure such as for a replaceable battery.

The motion sensing device shown in FIG. 10 and adapted in, FIG. 11 to be effectively connected with logic means and a display for game play comprises an alternate embodiment of the present invention. The combination of the motion sensing device adapted to enable an activatable switch or switches and logic means and display for game play is a sealable game means of the present invention. As such, the sealable game means comprises alone and without limitation to the specific toothbrush or toothbrushing reinforcement devices or games described herein, comprises an alternate embodiment of the present invention.

It is known in the art to provide microprocessor and associated circuitry for interactive electronic games upon a circuit board having a relatively small horizontal area. The motion sensing means of FIGS. 10 and 11 comprise a device of approximate dimensions, for example, of a shell length of less than about 3 millimeters to more than about 15 millimeters wherein such a game switching means may easily be located upon the circuit board for a small interactive game such as is common for electronic "Tamagotchi"-type pets. The availability of 3 game switches at a highest level game mode can be used as a menu selector for sub-menu options, i.e., eating, exercise or health related options which would be presented on the display, whereby the switch connection closing the switch circuit would be adapted to cause the display to show sub-menu options such as, for eating, options for food or water. Alternately, for shooting games, such as for jet fighter or walk through games, the top menu mode would permit the user to select from jets presented on the display as left to right options or 1 to 3 options corresponding to the FIG. 11 left zone 103A contacts, center zone 103B contacts and right zone 103C contacts in the game mode connected by the ball register cause the logic means to register as a game action. The registry of the actions is the functional equivalent of a game user pressing user interface buttons for a typical interactive game.

Figure 13:
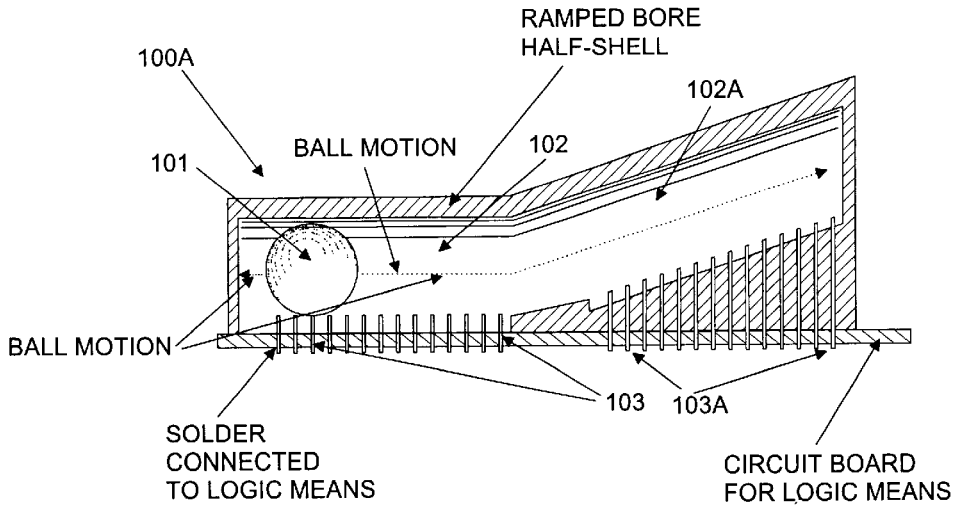
FIG. 13 is a side, cutaway view of a ramped embodiment of the present invention.

FIG. 13 represents an alternate game switch and/or motion sensor as described above. Wherein FIG. 10 shows a motion sensing assembly 100, FIG. 13 is a similar cross section view of game switch assembly 100A. Contacts 103 and 103A comprise two groups of contacts adapted to be connected to the logic means as switches during game mode operation. Contacts 103 may further comprise one or more sets of zone contacts as described above whereby contacts 103A may comprise additional sets of such zone contacts. The up-ramp bore 102A is generally has an axis at an acute angle to the axis of bore 102. The user could be required to perform more active side to side motion to raise the ball 101 into that bore 102A and thereby activate switches 103A. Such relative orientation of bore 102 to 102A may alternately be achieved such that both axes of bores 102 and 102A are substantially parallel to the circuit board although in acute angle relationship.

Figure 14:
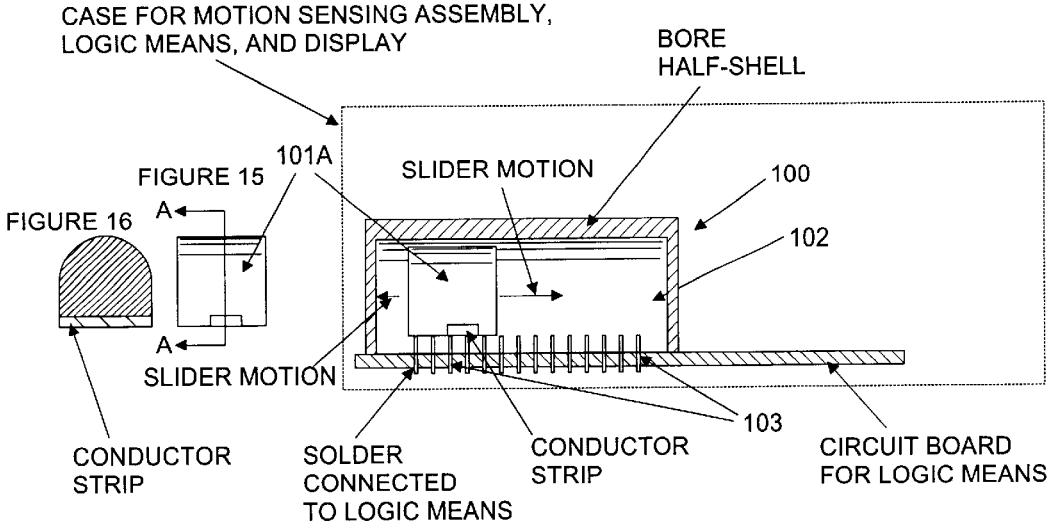
FIG. 14 is a side; cutaway view of an alternate device for making electrical connection with pins.

It is intended that ball 101 comprise any substantially round, oval cylindrical or other internal support for material on the surface which is sufficiently electrically conductive for the objects of the invention whereby a circuit is completed between contacts. The disclosures of FIGS. 13–16 are made with the understanding that the game switches of FIG. 11 may be distributed at convenient locations among the contacts 103 and/or 103A to accommodate a variety of game response operations. FIG. 14 discloses an alternate means for causing side by side contacts of contacts 103 to be connected and thereby completing a circuit for the objects of the invention. A slider 101A is adapted to slide back and forth in the bore half shell on the circuit board for the logic means. Section AA of FIG. 15 shows that an electrically conductive conductor strip is fixed along a bottom side of an otherwise non-conductive slider 101A.

Figure 17:
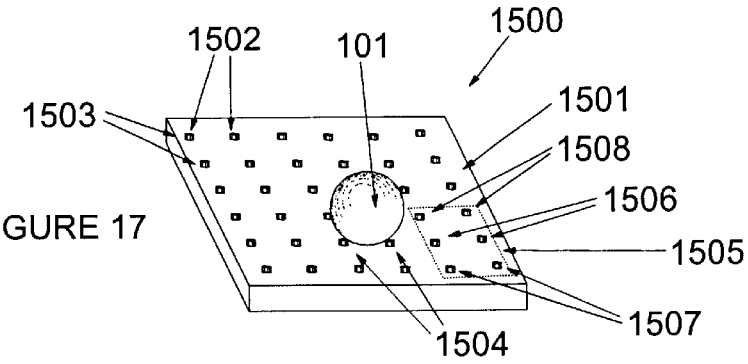
FIG. 17 is a top, orthogonal view of an exemplary grid of electrical contacts according to the present invention.

FIG. 17 shows an important expansion of the invention concept of a single line of electrical contacts used as described above for game switches or motion sensing. FIG. 17 shows a grid 1500, generally consisting of a support 1501 and conductive contacts, such as contacts 1504, supported in such a manner on support 1501 so that a relatively freely movable contact connection device such as ball 101 may move among and/or over the contacts, whereby the contact connection device comprises (1) a mass sufficient to urge movement of the device among and/or over the contacts upon relative motion of the support 1501 and (2) a conductive surface section sufficiently supported on the surface of the device such that it is capable of forming a contact between two adjacent contacts of the rows or columns of the grid (as in columns 1502 and rows 1503). An exemplary connection is shown in FIG. 17 being made by a conductor surfaced ball 101 between contacts 1504. The contacts of grid 1500 are, for example, pins that extend through a circuit board to electrical connections on the other side, conductively exposed sections of circuits on the top side of a printed circuit board or upward solder extensions thereof, or other such wide range and manner of presenting to the slider, ball or other such contact connection device adjacent contacts for activation of the game switch or motion sensing as described above. The contacting surfaces of the contacts may be raised above or substantially at the level of support 1501 depending on the type of contact connection device used.

A directional detection of the motion of the contact connection device may be sensed by the logic means of the present invention. For example, the contact pairs sequence 1508, 1506, and 1507 may be activated as a contact connection device moves from a rearward to forward position on the grid 1500 of FIG. 17. The sequential activation of those contact pairs delivers information to logic means adapted to identify two dimensional movement of the contact connection device relative to the support surface of support 1501.

Figure 18:
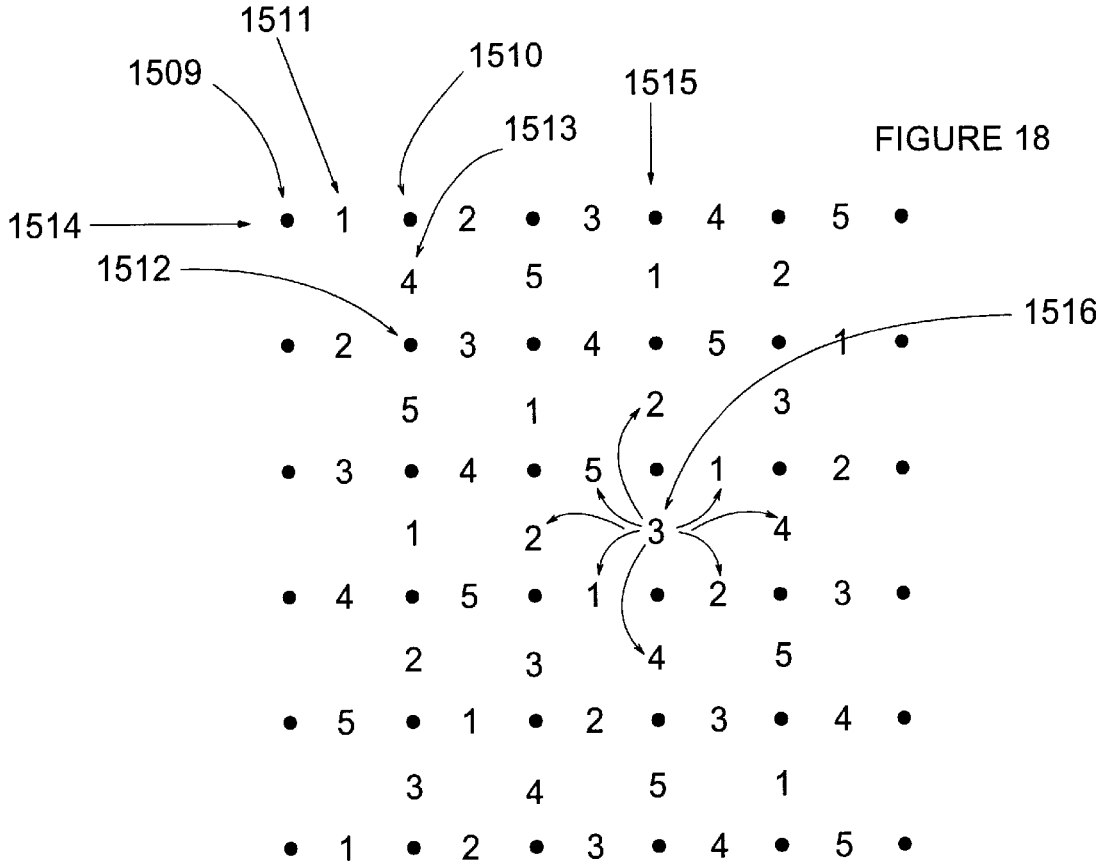
FIG. 18 is a top view of FIG. 17.

FIG. 18 is a diagram top view of exemplary contacts grid. The numbers 1–5 identify adjacent contact connections across which connection is made by the contact connection device. For example, contacts 1509 and 1510 have between them row connection 1511 with a number "1" between the contacts and contacts 1510 and 1512 have between them connection 1513 with a number "4" between the contacts. Row 1514 and column 1515 comprises, respectively, left to right and top to bottom connections 1–5. A contact connections device in connection 1516 at the number "3" may potentially only move to activate only one of the adjacent connections shown by the arrows extending from the connection 1516, i.e., to connections identified by the numbers 2, 1, 2, 4, 1, 2, and 5 clockwise from the top number shown in FIG. 18. The numbers 1–5 are the minimum number of connection-identified numbers to the logic means required so that adjacent connections do not identify the same number as that of an originating connection as for connection 1516. In addition, connection sequences 3/5, 1/4, 2/5, 1/3, and 2/4 and vice versa are direction identifiers, as to FIG. 18, of the contact connection device movement in a diagonal movement from bottom left to top right or vice versa. Therefore, the grid of FIG. 18 shows numbers 1–5 as electrical connections which translate to electrical connections to the logic means which senses those connections and stores occurrences of such numbers 1–5 in the logic means. Alternately, groups of three or more adjacent contacts as shown in FIG. 18 may cause contact connection thereamong to cause the logic means to register and store an occurrence of a single such number as just described. Although the numbers 1–5 are described in this example, any appropriately distinguishable sequence of alphanumeric characters may be so used for registration and occurrence summing in the logic means, or which are appropriately adapted therefore.

Although in FIGS. 17 and 18 encapsulating means are not shown for the grids, it is understood that restriction on the motion of the ball or slider is such that a relatively flat surface above and around the sides of the support surface prevents the ball or slider from being removed from contact with the support surface during the above described operation of the grid and ball or slider to accomplish the objects of the invention.

The present invention also comprises a toothbrush with a display displaying one or more icons in response to any of the several inputs from a user of the toothbrush. A logic means may be connected with a user interface such as the above motion sensor, buttons (or other pressure sensitive means), timers (for indication of an elapsed toothbrushing time or other such useful time period), joysticks, toothbrush bristle or handle pressure response sensors, or other such means, such that one or more user interface actions input to the logic means cause the display to display an icon instead of a bit-mapped display. The bit-mapped display requires expensive and complex IC's and display. The above described iconbased response to toothbrushing indication and game play overcomes that limitation. The present invention comprises a device dramatically reduced in cost over a similar toothbrush having a bit-mapped display.

I claim:

1. A toothbrush for reinforcing brushing behavior comprising:

(a) the toothbrush supporting a motion sensing assembly, a logic means for receiving a motion sensing assembly input and outputting a display output, and a display;

(b) the motion sensing assembly comprising a shell having a bore, closely associated electrical contacts in the bore and a mobile electrically conductive object capable of rolling within the bore across the contacts; and (c) the logic means is electrically connected with the contacts such that adjacent contacts comprise an uncompleted circuit which closes on connection by the mobile electrically conductive object, whereby logic means records such circuit completions as counts.

* * * * *